United States Patent [19]

Jensen et al.

[11] Patent Number: 4,549,849

[45] Date of Patent: Oct. 29, 1985

[54] PUMPING ASSEMBLIES

[75] Inventors: Niels D. Jensen; Kurt F. Nielsen, both of Bjerringbro, Denmark

[73] Assignee: Grundfos A/S, Bjerringbro, Denmark

[21] Appl. No.: 483,677

[22] Filed: Apr. 11, 1983

[30] Foreign Application Priority Data

May 29, 1982 [DE] Fed. Rep. of Germany ..... 3220448

[51] Int. Cl.[4] ..... F04D 29/40

[52] U.S. Cl. ..... 415/219 R; 415/219 C

[58] Field of Search ..... 415/219 C, 219 R; 417/360; 29/156.8 CF, 156.8 R

[56] References Cited

U.S. PATENT DOCUMENTS

| | | | |
|---|---|---|---|
| 3,059,582 | 10/1962 | Greene et al. | 415/219 C |
| 3,612,717 | 10/1971 | Burns | 415/219 C |
| 3,620,042 | 11/1971 | Gray | 415/219 C X |
| 3,924,963 | 12/1975 | Zerrer | 415/219 C |
| 3,967,915 | 7/1976 | Litzenberg | 415/219 C X |

FOREIGN PATENT DOCUMENTS

| | | | |
|---|---|---|---|
| 2405384 | 6/1979 | France | 415/219 C |

*Primary Examiner*—Everette A. Powell, Jr.

*Attorney, Agent, or Firm*—Balogh, Osann, Kramer, Dvorak, Genova & Traub

[57] ABSTRACT

This invention relates to a pumping assembly for heating and faucet water plants, comprising a wet-armature motor and a centrifugal pump driven thereby, the casing of which is pressed to shape from metal plate and has an axially directed collar against which bears the encircling marginal area of a partition separating the pumping space from the motor space, and which is joined by welding to an equally encircling marginal area of the split tube separating the armature space from the stator space. A particularly uncomplicated and safe joint results between the components in question due to the fact that, in accordance with the invention, the partition and the split tube are interwelded at least at points in their mutual contact area and are, jointly with the armature connected to the pump casing, to form a structural unit ready for installation, by connecting the collar of the pump casing in liquid-tight manner to the said marginal area of the split tube by pressure welding.

6 Claims, 3 Drawing Figures

FIG. 1
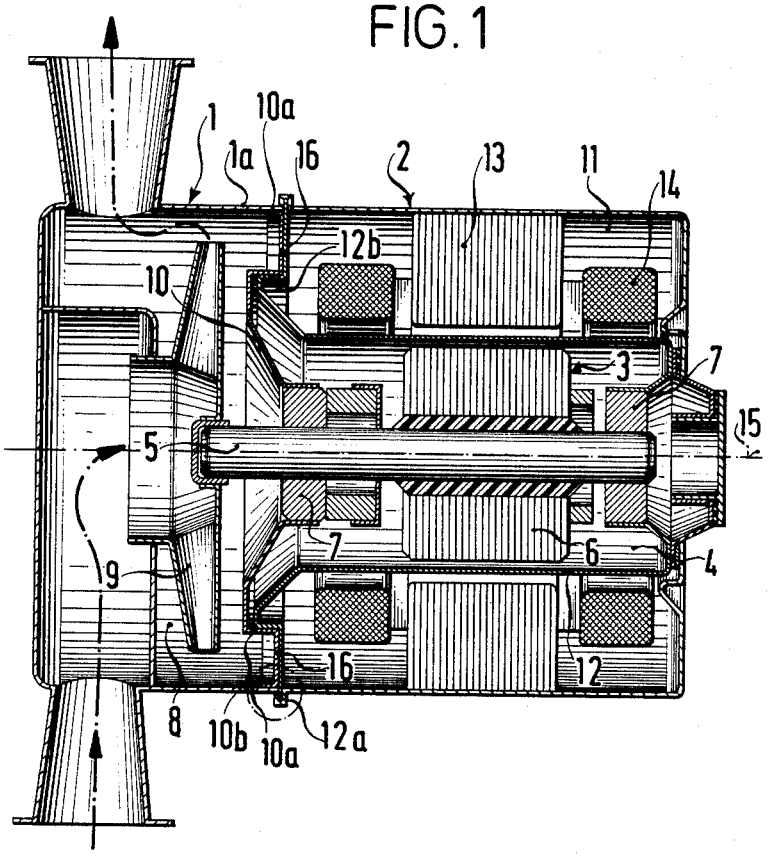
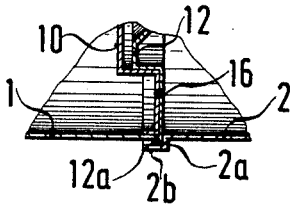
FIG. 3
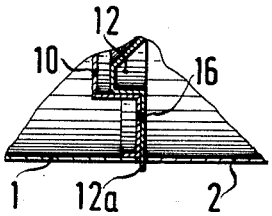
FIG. 2

PUMPING ASSEMBLIES

BACKGROUND OF THE INVENTION

The present invention relates to a pumping assembly for heating and faucet water plants of the kind comprising a wet-armature motor and a centrifugal pump driven thereby, and a casing pressed to shape from metal plate that has an axially oriented collar against which bears an encircling marginal area of a partition separating a pumping space from a motor space, and which is joined by welding to an encircling marginal area of a split tube separating an armature space and a stator space.

Pumping assemblies of this nature have some shortcomings in respect of the joint between the two casings, notwithstanding whether the pump and motor casings consist of cast or plate metal. The connection is commonly established by bolting together of the casing flange in mutual contact, in which connection an uneven tightening of the screws or bolts may have the result that internally situated components of the assembly are strained and that the shaft for example may thereby be caused to jam or seize in the bearings by skewing.

Apart from the bolts as the actual connecting means, several seals also have to be provided between the casing flanges or marginal areas of the partition and split tube which are to be joined together, there being three seals as a rule, which currently represent a definite risk because they become ineffective in the course of time by being compacted and embrittled and can no longer perform their sealing function. Moreover, it is understandable that the comparatively numerous parts needed for a tight joint by means of bolts represents a comensurate expenditure in respect of costs and assembling periods.

A substantial improvement may be obtained in this respect if, in accordance with the proposal described in the prior German Patent Application No. P 32 10 762.5, the pump and motor casings are pressed from metal plate and the casing flanges projecting outwards radially at the point of connection of the casings are interwelded encirclingly, that is to say if applicable simultaneously with the marginal area or flange present thereat of the partition and of the split tube. This method could however allow other problems to arise.

Upon establishing the welded joint between the radial flanges by means of a seam produced by fusion welding by means of gas, the casing is heated not only intensively but also asymmetrically. This may possibly have the result that the split tube and the partition with the bearings situated therein undergo stressing with respect to each other so that the armature jams and that a commensurate expense will thereupon be incurred because it then becomes necessary to disassemble the parts.

It is an object of the invention to provide a joint between the components to be interwelded, which is uncomplicated, remanently tight without separate sealing means as well as producible without risk to the other components of the assembly.

SUMMARY OF THE INVENTION

This problem is resolved according to the invention by spot welding the partition and the split tube at least in their area of mutual contact and, together with the armature, they are joined to the pump casing as a structural unit ready for installation, by joining the collar of the pump casing in liquid-tight manner to said marginal area of the split tube by pressure welding.

If the armature shaft has been inserted into the bearing situated in the split tube and the partition containing the front bearing for the shaft has been secured by spot-welding to the split tube, in such manner that the positions of the shaft and bearings are concentric, what is produced is an easy-running "power unit". This should then be connected to the pump casing, in such manner as to retain the concentric nature of the "running gear".

Pressure welding is a very simple method appropriate for the purpose of interconnecting the pump casing and split tube of the "power unit". This method not only holds the thermal strain on the parts to be connected to a low value, but the thermal strain also intervenes throughout the periphery or simultaneously in all areas of the area of connection, so that the risk of warping of the interwelded parts is avoided or at least reduced to a minimum. It should be stated moreover that press-welded joints are normally more economical in series production than other welded joints.

The possibility exists moreover that the motor casing may be joined to the split tube at its other side, apart from joining the pump casing to the split tube, during the same operation by means of pressure welding.

BRIEF DESCRIPTION OF THE DRAWINGS

In order that the invention may be more clearly understood, reference will now be made to the accompanying drawings which show certain embodiments thereof by way of example in diagrammatic form and in which:

FIG. 1 shows a longitudinal cross-section through a pumping assembly, and

FIGS. 2 and 3 show partial cross-sections through two other pumping assemblies in the areas which are enflanked by the dotted circle in FIG. 1.

DETAILED DESCRIPTION OF THE PREFERRED EMBODIMENTS

Referring now to the drawings the pumping assembly shown, which may in particular serve the purpose of circulating water in heating and faucet water plants, comprises a centrifugal pump having a casing 1 and an electric wet-armature motor comprising a casing 2, the armature 3 of which revolves within an armature space 4 filled with water.

At either side of the armature stack of laminations 6, the shaft is carried by two radial bearings 7. An impeller 9 of the pump is secured on the end of a shaft 5 projecting into a pumping space 8.

A partition 10 separates the pumping space 8 and the armature space 4 which for its part is sealed from a dry stator space 11 by means of a split tube 12. The stator stack of laminations 13 and the motor windings 14 are situated within the stator space 11. The motor in this form of construction consequently consists of a squirrel-cage induction motor.

Pumping assemblies of this nature are moreover generally known in respect of their structure and function, so that a more explicit description is unnecessary and reference may be made to similar pumping assemblies which were previously known, for example as illustrated and described in the German Offenlegungs Specifications Nos. 25 16 575, 25 29 399 and 26 39 540.

The two casings 1 and 2, the partition 10 and the pot-like split tube 12, are metal plate pressings. The pump casing 1 has an axially directed collar 1*a* into which is inserted an oppositely axially directed collar 10*a* of the partition 10. Both collars extend encirclingly and concentrically around the longitudinal axis 15 and bear tightly against each other. The free edge 12*a* of the encircling marginal area of the split tube 12 projects radially outwards beyond the collar 1*a*.

As has already been stated in the foregoing, the armature 3, the split tube 12 and the partition 10 are first assembled into one unit ready for installation, that is in such manner that the armature shaft 5 and the bearings 7 are aligned precisely concentrically with respect to the axis 5, whereby the required easy running characteristic is assured. The split tube 12 and the partition 10 are then interwelded by spots in their mutual contact area, for example at the points 16. An uninterrupted welded joint encircling the longitudinal axis 15 would also be possible, but is needed only if it is intended to interconnect the partition 10 and the split tube 12 in totally hermetic manner and a tight joint of this nature cannot be accomplished by any other means.

The partition and the split tube should however be secured by mutual engagement against a radial displacement with respect to each other, so that these members may be mutually braced and that the concentricity may moreover be retained during assembling and during the subsequent welding operation. To this end, the partition 10 and the split tube 12 comprise shoulders 10*b* and 12*b* extending concentrically around the axis 15 and bearing against each other.

The structural unit substantially comprising the armature, split tube and partition, may then be joined to both casings 1,2 by applying it against the pump casing 1 so that the collar 10*a* engages in and below the collar 1*a*. The encircling marginal area of the split tube 12 is then connected in liquid-tight manner to the extremity of the collar 1*a* bearing against it, by pressure welding.

In order that the motor casing 2 need not be joined to the pump casing by a separate operation, the pump-side rim of the motor casing 2 bearing against the radial rim area of the split tube 12 may at the same time be joined directly by pressure welding to the split tube and thereby indirectly to the pump casing, as shown in FIG. 2.

On the other hand, the motor casing 2 may also be connected in form-locked manner to the pump casing 1 or to the said unit ready for installation, if in accordance with FIG. 1, the rim of the motor casing is swaged over the radially projecting rim 12*a* of the split tube 12 at the join.

Finally, according to FIG. 3, the rim of the motor casing 2 may be stepped and on the one hand may bear with a shoulder 2*a* against the outer rim of the split tube 12 and on the other hand may engage over the join with a cylindrical section 2*b*. In this case, the motor casing and the pump casing may be inter-engaged releasably, whereas the mutual connection between the parts in question may for example be established by means of clamps not shown otherwise, which bear externally on the shoulder 2*a* and on the pump-side surface of the marginal area 12*a*.

We claim:

1. In a pumping assembly for heating and faucet water plants of the kind comprising a wet-armature motor and a centrifugal pump driven thereby, and connected pump and motor casings pressed to shape from metal plates, said pump casing having an axially oriented collar which bears and encompasses a marginal area of a partition delimiting a pumping space from a motor space and which is joined by a weld joint to an encircling marginal area of a split tube separating an armature space from a stator space, the invention which consists in that said partition and said split tube are joined at least by partial weldings in their mutual contact area to provide a structural unit ready for installation and including the armature end thereof, said structural unit conjointly with said armature being joined to said pump casing by a liquid-tight pressure weld joining said pump casing collar to said marginal area of said split tube.

2. A pumping assembly according to claim 1, wherein said partition has an axially directed collar which is concentrically inserted under tight contact in said axially oriented collar of said pump casing and over which radially projects a free edge of said encircling marginal area of said split tube.

3. A pumping assembly according to claim 1, wherein said partition and said split tube are secured against radial displacement with respect to each other by mutual engagement.

4. A pumping assembly according to claim 1, wherein said motor casing is pressed to shape from metal plate and is connected at a pump-side rim thereof to said pump casing, wherein said rim of said motor casing is also joined by pressure welding to said radial encircling marginal area of said split tube.

5. A pumping assembly according to claim 1, wherein said motor casing is pressed to shape from metal plate and is connected to said pump casing at a pump-side rim thereof, wherein said motor casing is joined in form-locked manner to said structural unit comprising said partition and said split tube, ready for installation.

6. A method of manufacturing a pumping assembly used in heating and faucet water plants of the kind having a wet-armature motor and a centrifugal pump driven thereby, housed in motor and pump casings, respectively, pressed to shape from metal plates, said wet-armature motor being separated from said centrifugal pump by a metal-pressed pot-like split tube adjoining a metal-pressed partition, comprising the steps of joining together the partition and split tube at least by partial welding in their mutual contact areas, thereby producing a structural unit including an armature and bearings of said motor, joining said structural unit conjointly with said armature to said pump casing by a liquid-tight pressure weld which joins a collar of said pump casing to a marginal area of said split tube, and joining said motor casing to said pump casing.

* * * * *